US009044934B2

(12) United States Patent
Kakigahara

(10) Patent No.: US 9,044,934 B2
(45) Date of Patent: Jun. 2, 2015

(54) LIQUID DISCHARGE APPARATUS, LIQUID DISCHARGE METHOD, AND STORAGE MEDIUM STORING INSTRUCTIONS FOR LIQUID DISCHARGE APPARATUS

(71) Applicant: BROTHER KOGYO KABUSHIKI KAISHA, Nagoya-shi, Aichi-ken (JP)

(72) Inventor: Yutaka Kakigahara, Nagoya (JP)

(73) Assignee: BROTHER KOGYO KABUSHIKI KAISHA, Nagoya-Shi, Aichi-Ken ( * ) Notice: Subject to any disclaimer, the term of this patent is extended or adjusted under 35 U.S.C. 154(b) by 0 days.

(21) Appl. No.: 14/304,003

(22) Filed: Jun. 13, 2014

(65) Prior Publication Data

US 2015/0035888 A1 Feb. 5, 2015

(30) Foreign Application Priority Data

Jul. 31, 2013 (JP) ..... 2013-159357

(51) Int. Cl.
*B41J 2/155* (2006.01)
*B41J 2/045* (2006.01)

(52) U.S. Cl.
CPC ..... *B41J 2/04505* (2013.01)

(58) Field of Classification Search
None
See application file for complete search history.

(56) References Cited

U.S. PATENT DOCUMENTS 5,467,114 A * 11/1995 Ebinuma et al. ..... 347/32
8,287,068 B2 * 10/2012 Shimizu et al. ..... 347/9
2008/0049058 A1 2/2008 Yakura et al.
2010/0245418 A1 9/2010 Shimizu et al.

FOREIGN PATENT DOCUMENTS

JP 2005-022314 A 1/2005
JP 2010-234735 A 10/2010

* cited by examiner

*Primary Examiner* — Lamson Nguyen
(74) *Attorney, Agent, or Firm* — Merchant & Gould PC

(57) ABSTRACT

A liquid discharge apparatus includes: a liquid discharge head having a plurality of discharge ports arranged in a first direction; a transport mechanism which transports a recording medium in a second direction perpendicular to the first direction; a platen which is provided opposingly to the plurality of discharge ports and which supports the recording medium, the platen having an opening and an auxiliary support portion; a liquid receiving member which is provided on a side opposite to the liquid discharge head with respect to the platen and which receives a liquid discharged from the plurality of discharge ports; a movement mechanism which moves the auxiliary support portion of the platen between a first position and a second position separated in the first direction from the first position; and a control unit which controls the liquid discharge head and the movement mechanism.

12 Claims, 10 Drawing Sheets

FIRST POSITION
X1
X2
33
35
40
41

SECOND POSITION
33
35
40
41

FIRST POSITION
A
B
C
E
H

SECOND POSITION
A
C
D
FIRST DIRECTION

LIQUID DISCHARGE APPARATUS, LIQUID DISCHARGE METHOD, AND STORAGE MEDIUM STORING INSTRUCTIONS FOR LIQUID DISCHARGE APPARATUS

CROSS REFERENCE TO RELATED APPLICATION

The present application claims priority from Japanese Patent Application No. 2013-159357, filed on Jul. 31, 2013, the disclosure of which is incorporated herein by reference in its entirety.

BACKGROUND OF THE INVENTION

1. Field of the Invention

The present invention relates to a liquid discharge apparatus for discharging a liquid onto a recording medium, a liquid discharge method, and a storage medium storing a program (instruction) used for the liquid discharge apparatus.

2. Description of the Related Art

An ink jet recording apparatus is known, wherein an ink or inks is/are discharged from a head to form an image on each of recording paper sheets transported continuously in one direction while providing a predetermined spacing distance. A plurality of discharge ports, from which the ink is discharged, are arranged on a lower surface of the head. The discharge ports undergo, in some cases, the occurrence of the clog-up and/or the discharge failure due to, for example, the drying of the ink and the adhesion of any foreign matter. In order to avoid such an inconvenience, the flushing operation, which is the ink discharge that does not contribute to the image formation, is performed in the ink jet recording apparatus, if necessary. Further, the ink-jet recording apparatus is provided with a platen which receives the back surface of the recording paper to be transported, while being opposed to the lower surface of the head. The platen is provided with a plurality of slender ribs as auxiliary support portions for receiving the back surface of the recording paper. The longitudinal direction of the rib is substantially parallel to the transport direction of the recording paper, and the respective ribs have substantially the same height. Accordingly, the flatness is secured for the recording paper during the transport. In this context, if the rib is opposed to the discharge port formed on the lower surface of the head, it is feared that the back surface of the recording paper to be transported may be dirtied by the ink adhered to the apex of the rib during the flushing operation. Accordingly, in the case of the ink jet recording apparatus, the rib is missing or deleted in the area on the platen opposed to each of the discharge ports.

SUMMARY OF THE INVENTION

In the case of the conventional construction, the ribs are formed at the positions at which the ribs are not opposed to the discharge port. However, in general, the plurality of discharge ports are formed on the head. If the ribs are not formed at the positions at which the ribs are opposed to the discharge ports, it is sometimes difficult to secure the flatness of the recording paper during the transport. An object of the present invention is to provide a liquid discharge apparatus, a liquid discharge method, and a storage medium storing a program used for the liquid discharge apparatus, wherein an auxiliary support portion for a recording medium is suppressed from being dirtied on account of the flushing operation, while securing the flatness of the recording medium during transport.

According to a first aspect of the present invention, there is provided a liquid discharge apparatus including: a liquid discharge head in which a plurality of discharge ports for discharging a liquid are arranged in a first direction; a transport mechanism which is configured to transport a recording medium in a second direction perpendicular to the first direction; a platen which is provided opposingly to the plurality of discharge ports of the liquid discharge head and configured to support the recording medium to be transported by the transport mechanism, the platen having an opening which is formed so that the liquid, which is discharged from the plurality of discharge ports, passes therethrough, and an auxiliary support portion which is provided to be laid across a part of the opening so that the recording medium, which is to be transported across a position overlapped with the opening, is supported; a liquid receiving member which is provided on a side opposite to the liquid discharge head with respect to the platen and configured to receive the liquid discharged from the plurality of discharge ports of the liquid discharge head; a movement mechanism which is configured to move at least the auxiliary support portion of the platen between a first position and a second position separated in the first direction from the first position; and a control unit which is configured to control at least the liquid discharge head and the movement mechanism, wherein the liquid discharge head includes: a first area which is opposed to the auxiliary support portion and a second area which is opposed to the opening and which is different from the first area, in a state in which the auxiliary support portion is positioned at the first position; and a third area which is opposed to the auxiliary support portion and a fourth area which is opposed to the opening and which is different from the third area, in a state in which the auxiliary support portion is positioned at the second position, and wherein the control unit is configured to: control the movement mechanism so that the first area is included in the fourth area in the state in which the auxiliary support portion is positioned at the second position and the third area is included in the second area in the state in which the auxiliary support portion is positioned at the first position; control the liquid discharge head in the state in which the auxiliary support portion is positioned at the first position so that the liquid is discharged toward the liquid receiving member from the discharge ports of the plurality of discharge ports included in the third area; and control the liquid discharge head in the state in which the auxiliary support portion is positioned at the second position so that the liquid is discharged toward the liquid receiving member from the discharge ports of the plurality of discharge ports included in the first area.

According to a second aspect of the present invention, there is provided a liquid discharge method for a liquid discharge apparatus, the liquid discharge apparatus including a liquid discharge head in which a plurality of discharge ports for discharging a liquid are arranged in a first direction; a transport mechanism which is configured to transport a recording medium in a second direction perpendicular to the first direction; a platen which is provided opposingly to the plurality of discharge ports of the liquid discharge head and configured to support the recording medium to be transported by the transport mechanism, the platen having an opening which is formed so that the liquid, which is discharged from the plurality of discharge ports, passes therethrough, and an auxiliary support portion which is provided to be laid across a part of the opening so that the recording medium, which is to be transported across a position overlapped with the opening, is supported; a liquid receiving member which is provided on a side opposite to the liquid discharge head with respect to the platen and configured to receive the liquid discharged from the plurality of discharge ports of the liquid discharge head; a movement mechanism which is configured to move at least the auxiliary support portion of the platen between a first position and a second position separated in the first direction from the first position; and a control unit which is configured to control at least the liquid discharge head and the movement mechanism; wherein the liquid discharge head includes: a first area which is opposed to the auxiliary support portion and a second area which is opposed to the opening and which is different from the first area, in a state in which the auxiliary support portion is positioned at the first position; and a third area which is opposed to the auxiliary support portion and a fourth area which is opposed to the opening and which is different from the third area, in a state in which the auxiliary support portion is positioned at the second position; and the liquid discharge method comprising: controlling the movement mechanism so that the first area is included in the fourth area in the state in which the auxiliary support portion is positioned at the second position and the third area is included in the second area in the state in which the auxiliary support portion is positioned at the first position; controlling the liquid discharge head in the state in which the auxiliary support portion is positioned at the first position so that the liquid is discharged toward the liquid receiving member from the discharge ports of the plurality of discharge ports included in the third area; and controlling the liquid discharge head in the state in which the auxiliary support portion is positioned at the second position so that the liquid is discharged toward the liquid receiving member from the discharge ports of the plurality of discharge ports included in the first area.

According to a third aspect of the present invention, there is provided a storage medium storing computer-executable instructions for a liquid discharge apparatus, the liquid discharge apparatus comprising: a liquid discharge head in which a plurality of discharge ports for discharging a liquid are arranged in a first direction; a transport mechanism which is configured to transport a recording medium in a second direction perpendicular to the first direction; a platen which is provided opposingly to the plurality of discharge ports of the liquid discharge head and configured to support the recording medium to be transported by the transport mechanism, the platen having an opening which is formed so that the liquid, which is discharged from the plurality of discharge ports, passes therethrough, and an auxiliary support portion which is provided to be laid across a part of the opening so that the recording medium, which is to be transported across a position overlapped with the opening, is supported; a liquid receiving member which is provided on a side opposite to the liquid discharge head with respect to the platen and configured to receive the liquid discharged from the plurality of discharge ports of the liquid discharge head; a movement mechanism which is configured to move at least the auxiliary support portion of the platen between a first position and a second position separated in the first direction from the first position; and a control unit which is configured to control at least the liquid discharge head and the movement mechanism; wherein the liquid discharge head includes: a first area which is opposed to the auxiliary support portion and a second area which is opposed to the opening and which is different from the first area, in a state in which the auxiliary support portion is positioned at the first position; and a third area which is opposed to the auxiliary support portion and a fourth area which is opposed to the opening and which is different from the third area, in a state in which the auxiliary support portion is positioned at the second position, and the instructions, when executed by a processor, causing the liquid discharge apparatus to: control the movement mechanism so that the first area is included in the fourth area in the state in which the auxiliary support portion is positioned at the second position and the third area is included in the second area in the state in which the auxiliary support portion is positioned at the first position; control the liquid discharge head in the state in which the auxiliary support portion is positioned at the first position so that the liquid is discharged toward the liquid receiving member from the discharge ports of the plurality of discharge ports included in the third area; and control the liquid discharge head in the state in which the auxiliary support portion is positioned at the second position so that the liquid is discharged toward the liquid receiving member from the discharge ports of the plurality of discharge ports included in the first area.

When the auxiliary support portion is moved in the first direction between the first position and the second position, the control unit does not allow the liquid to be discharged at the first position from the discharge ports included in the first area, and the control unit allows the liquid to be discharge at the second position from the discharge ports included in the first area. Further, the control unit does not allow the liquid to be discharged at the second position from the discharge ports included in the third area, and the control unit allows the liquid to be discharged at the first position from the discharge ports included in the third area. That is, the auxiliary support portion is moved in the first direction between the first position and the second position, and thus the liquid can be discharged uniformly from all of the discharge ports without adhering the liquid to the auxiliary support portion. Accordingly, the auxiliary support portion can be formed at the position opposed to the discharge port, and it is possible to secure the flatness (evenness) of the recording medium during the transport. Further, even when the plurality of discharge ports are formed, the discharge ports are not opposed to the auxiliary support portion, and it is possible to reliably prevent the auxiliary support portion from being dirtied by the liquid. The flatness (evenness) of the recording medium herein represents the degree of flatness or evenness of the recording medium, which is synonymous with the flatness (degree of flatness) defined in Japanese Industrial Standards. In the following description, the flatness (evenness) is used in this meaning The present invention can be constructed in various forms including, for example, the liquid discharge apparatus, the liquid discharge method, and the storage medium for storing the program for the liquid discharge apparatus.

DESCRIPTION OF THE PREFERRED EMBODIMENTS

An embodiment of the present invention will be explained below with reference to the drawings. In the following description, the term "upper side" and the term "lower side" indicate the upper side and the lower side in relation to the vertical direction. An ink jet recording apparatus is exemplified as the "liquid discharge apparatus" according to the present invention, an ink is exemplified as a specified example of the "liquid", and a recording paper sheet (recording paper) is exemplified as a specified example of the "recording medium".

Figure 1:
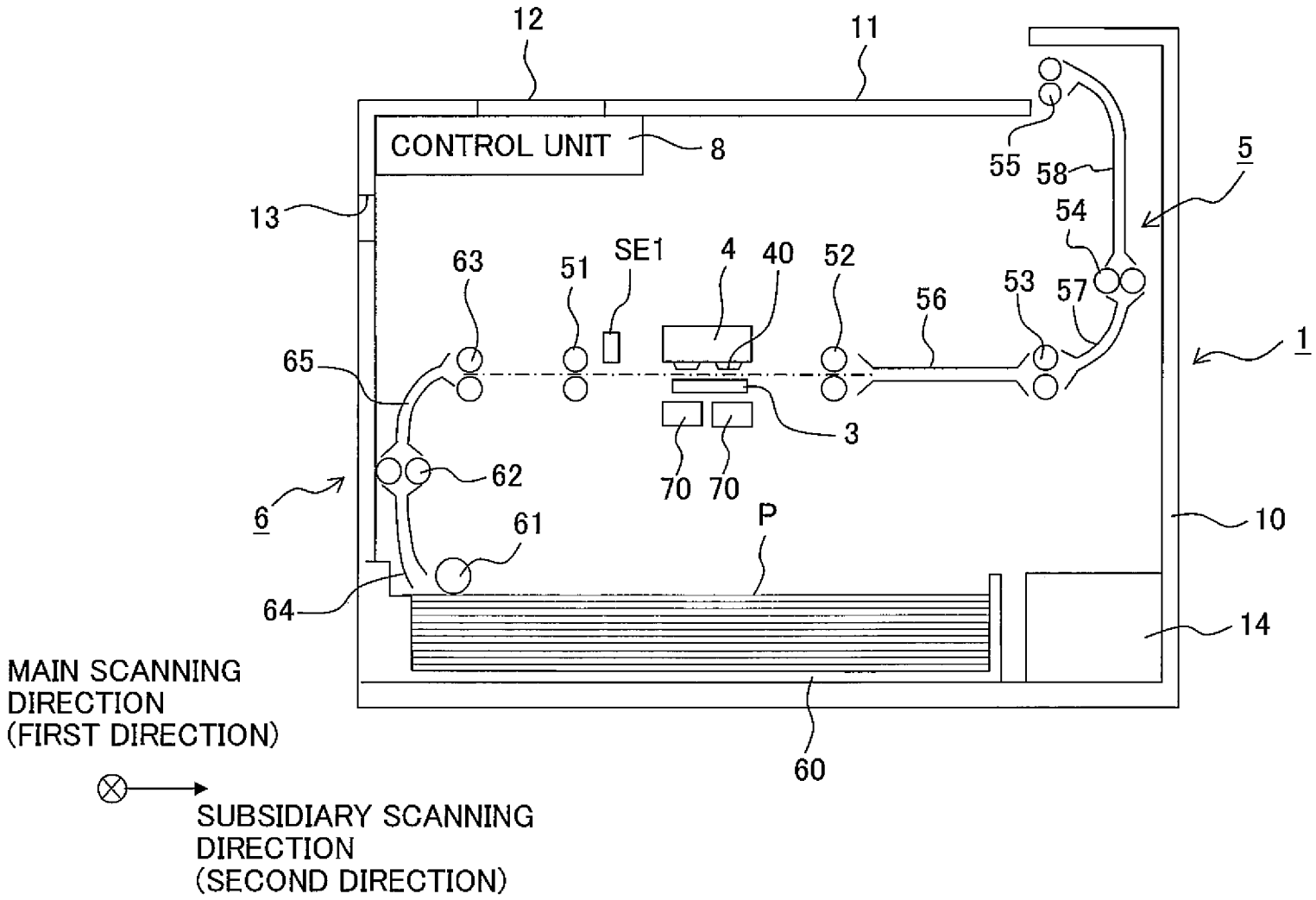
FIG. 1 shows an overall structure of an ink jet recording apparatus.

As shown in FIG. 1, the ink jet recording apparatus 1 has a rectangular parallelepiped-shaped casing 10. A tray 11 for discharging the recording paper P is provided at an upper portion of a ceiling plate of the casing 10. In the casing 10, those arranged from the upper side to the lower side are a liquid discharge head 4 which discharges the ink or inks toward the recording paper P, a transport unit 5 which transports the recording paper P horizontally and which thereafter feeds the recording paper P to the tray 11, and a paper feed unit 6 which supplies the recording paper P. A platen 3, which is opposed to the liquid discharge head 4 and which supports the recording paper P to be transported in the horizontal plane, is provided under or below the liquid discharge head 4. A control unit 8, which manages the operations of the respective mechanisms and the electric circuit included in the casing 10, is arranged at an upper portion inside the casing 10, at which no interference arises with respect to the liquid discharge head 4. A tank or tanks 14, in which the ink or inks to be supplied to the liquid discharge head 4 is/are accommodated, is/are arranged at a lower portion inside the casing 10. The tank 14 is connected to the liquid discharge head 4 by means of a tube (not shown). A terminal 13, into which a signal including an image recording job transmitted from an external personal computer, is provided on a side surface of the casing 10. The signal, which is inputted from the terminal 13, is inputted into the control unit 8. An operation panel 12, with which a user inputs the information, is provided on the upper surface of the casing 10. The transport unit 5 is such a mechanism that the recording paper P is transported from the left to the right as viewed in FIG. 1 and the recording paper P is transported upwardly to the tray 11. In the following description, the direction, which is perpendicular to the direction for transporting the recording paper P on the platen 3, is referred to as "main scanning direction" or "first direction", and the direction, in which the recording paper P is transported on the platen 3, is referred to as "subsidiary scanning direction" or "second direction".

The transport unit 5 includes first and second transport roller pairs 51, 52 which are disposed on the both sides in the subsidiary scanning direction of the liquid discharge head 4, third to fifth transport roller pairs 53, 54, 55 which are arranged on the downstream side in a transport direction of the recording paper P as compared with the transport roller pair 52, and three guides 56, 57, 58 through which the recording paper P is allowed to pass. An end detection sensor SE1, which detects the end (end portion) of the recording paper P to be transported, is provided between the first transport roller pair 51 and the liquid discharge head 4. The detection signal, which is outputted from the end detection sensor SE1, is transmitted to the control unit 8. When a downstream end of the transported recording paper P in the transport direction is detected by the end detection sensor SE1, the ink discharge, which is to be caused from the liquid discharge head 4 to the recording paper P, is started after the elapse of a predetermined time. The predetermined time corresponds to the time required for the recording paper P to be transported to the liquid discharge head 4 after the passage across the end detection sensor SE1. The recording paper P, to which the transport force is applied by the first transport roller pair 51, is transported in the horizontal plane, while receiving the ink discharged from the liquid discharge head 4.

The recording paper P passes across the lower side of the liquid discharge head 4, and then the transport force is applied thereto by the second transport roller pair 52 disposed on the downstream side in the transport direction. The recording paper P is fed to the tray 11 by the guides 56, 57, 58 and the third to fifth transport roller pairs 53, 54, 55 positioned between the second transport roller 52 and the tray 11. The paper feed unit 6 includes a paper feed tray 60 in which the recording paper P is accommodated, a paper feed roller 61, sixth and seventh transport roller pairs 62, 63 which are disposed between the paper feed roller 61 and the transport unit 5, and two guides 64, 65 through which the recording paper P is allowed to pass. The paper feed roller 61 picks up the sheet of the recording paper P one by one from inside of the paper feed tray 60, while providing a predetermined time interval. The recording paper P, which is picked up from inside of the paper feed tray 60 by the paper feed roller 61, is transported to the upstream side of the transport unit 5 by the guides 64, 65 and the sixth and seventh transport roller pairs 62, 63.

The liquid discharge head 4 is a line head having a rectangular parallelepiped-shaped form extending in the main scanning direction (first direction). A plurality of discharge ports for discharging the ink or inks, are formed on a discharge surface 40 as the lower surface of the liquid discharge head 4. The recording paper P, on which the image has been recorded by the liquid discharge head 4, is discharged to the tray 11 by the second to fifth transport roller pairs 52, 53, 54, 55 and the guides 56, 57, 58. A plurality of liquid receiving members 70, which are arranged horizontally, are provided under or below the platen 3 so that the plurality of liquid receiving members 70 are movable upwardly/downwardly with respect to the liquid discharge head 4. The liquid receiving member 70 is formed to have a cap-shaped form. The liquid receiving member 70 is positioned under or below the transport passage for the recording paper P so that the printing is not disturbed when the printing is performed by discharging the ink or inks onto the recording paper P.

Figure 2:
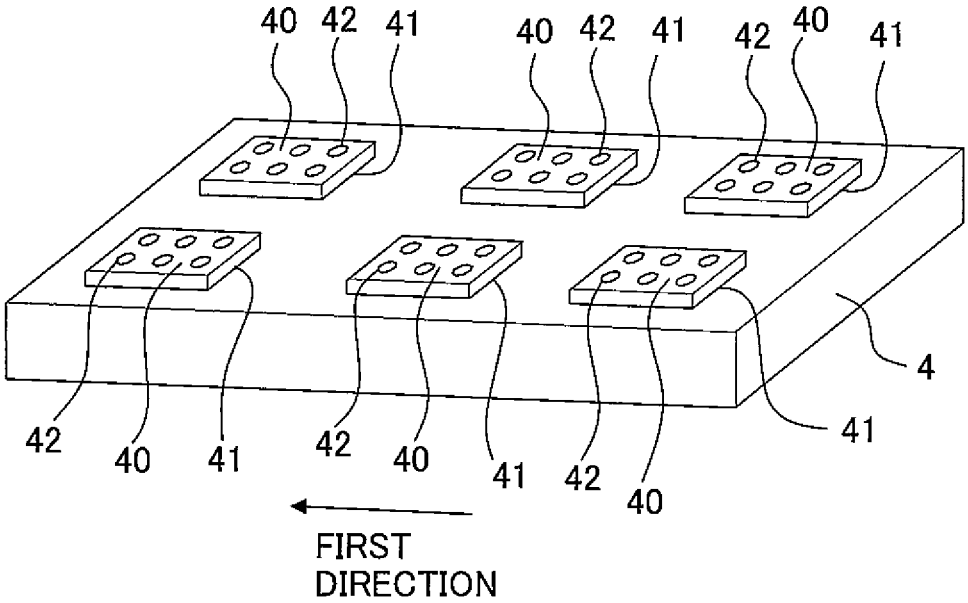
FIG. 2 shows a perspective view illustrating a liquid discharge head as viewed from a lower position.

As shown in FIG. 2, a plurality of head elements 41 are provided to protrude from the lower surface of the liquid discharge head 4. The head elements 41 are arranged in a zigzag form in the first direction. The discharge surface 40 is the lower surface of the head element 41. A plurality of discharge ports 42, which are the nozzles for discharging the ink, are formed on the discharge surface 40. Each of the head elements 41 has the same structure, for example, in order that the ink discharge characteristic is uniformized and the production cost is reduced. The liquid discharge head 4 is formed by arranging the six head elements 41 in the zigzag form in the first direction. However, the number of head elements 41 is not limited to six. The head element 41 is constructed by a flow passage unit which is formed by stacking a plurality of metal plates and an actuator unit which is joined to the upper surface thereof. When the electricity is applied to the actuator unit, the ink contained in the flow passage unit is discharged thereby. The lower surface of the metal plate positioned at the lowermost position of the flow passage unit constitutes the discharge surface 40, and the actuator unit is connected to the control unit 8. The construction as described above is known, any detailed description of which is omitted.

Figure 3:
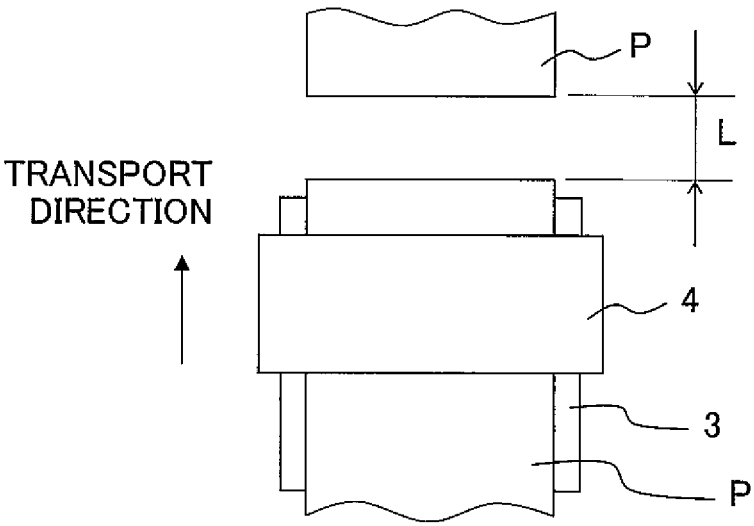
FIG. 3 shows a plan view illustrating a relationship between the liquid discharge head and a platen.

As shown in FIG. 3, a plurality of recording paper sheets P are continuously supplied between the liquid discharge head 4 and the platen 3, and the spacing distance L is provided in the transport direction between the two mutually adjoining recording paper sheets P. In the same manner as in the conventional technique, in the ink-jet recording apparatus 1, the clog-up of the discharge port 42 and/or the discharge failure occur(s) in some cases, for example, due to the drying of the ink and/or the adhesion of any foreign matter. In order to avoid such an inconvenience, the flushing operation of the ink is also performed in the ink jet recording apparatus 1, if necessary. The flushing operation is performed during the period which corresponds to the spacing distance L between the two adjoining sheets of the recording paper, and in which the recording paper P is not opposed to the discharge port 42. Therefore, the ink, which is discharged from the discharge port 42 in accordance with the flushing operation, does not adhere to the recording paper P, and any harmful influence is not exerted on the image formation.

Figure 4:
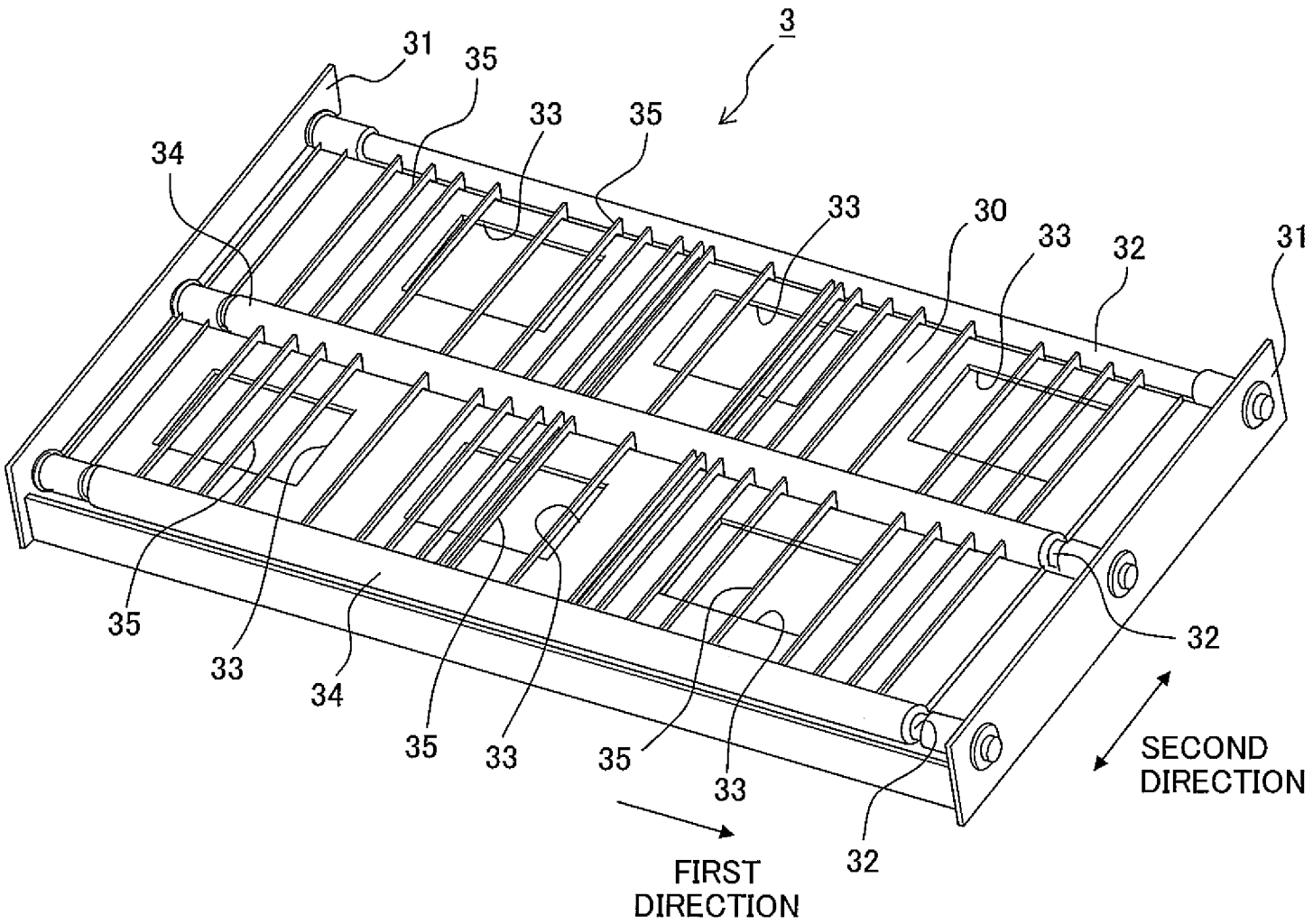
FIG. 4 shows a perspective view illustrating the platen.
Figure 5:
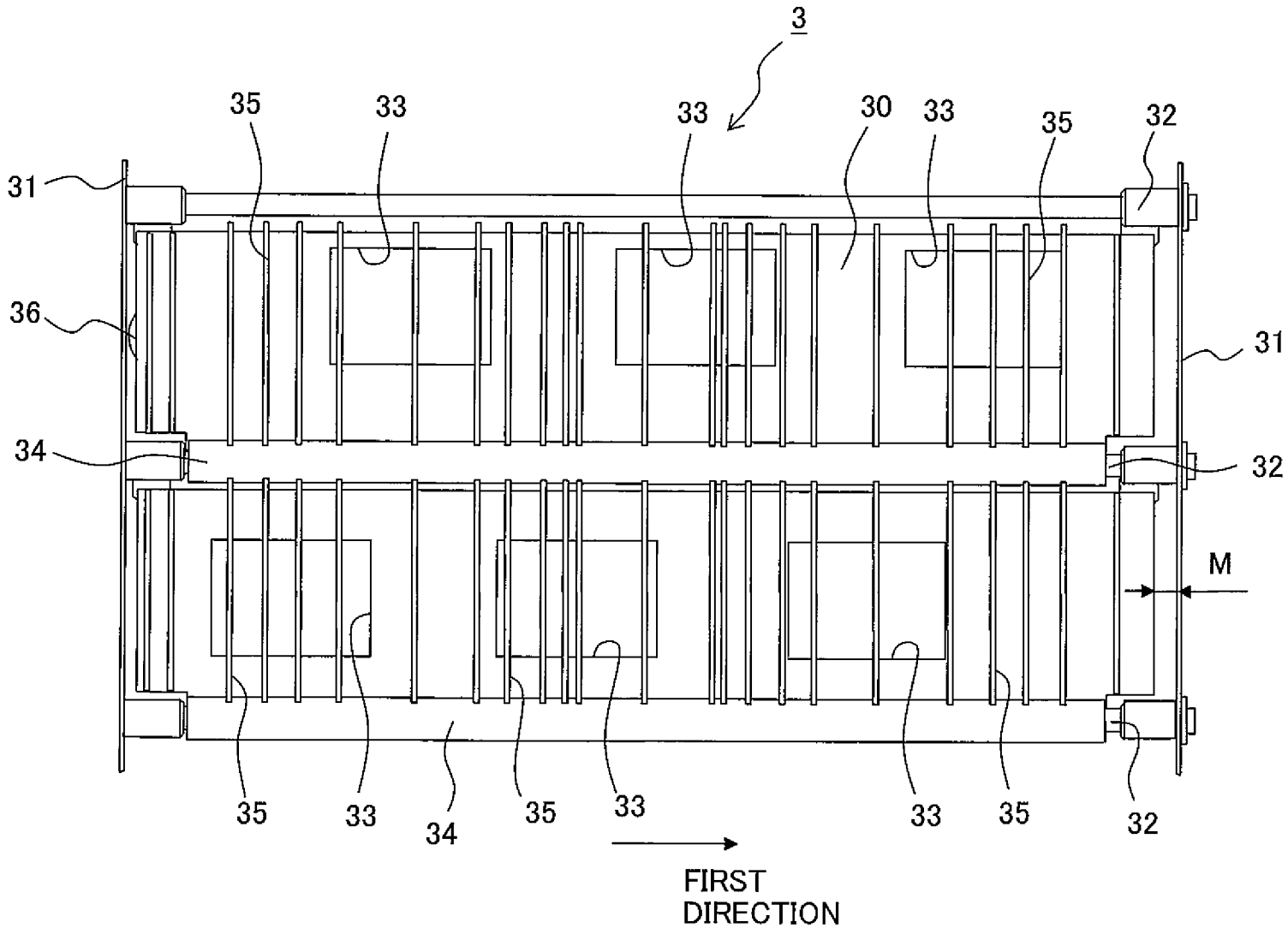
FIG. 5 shows a plan view illustrating the platen.

As shown in FIGS. 4 and 5, the platen 3 is provided with frames 31 which are constructed by mutually parallel metal plates, three support rods 32 which extend in the first direction and which connect the both frames 31, and support plate members 30 which are horizontal plates fitted to the support rods 32. A plurality of openings 33, which are opposed to the head elements 41, are formed on the support plate member 30. The plurality of openings 33 are formed in a zigzag form in the first direction so that the plurality of openings 33 are opposed to the plurality of head elements 41 arranged in the zigzag form in the first direction. When the plurality of openings 33 are formed in the zigzag form, it is possible to enhance the strength of the platen 3 as compared with a case in which the openings 33 are formed on one straight line in the first direction.

The support plate member 30 has a cylindrical portion 34 which is formed corresponding to the support rod 32 and which is slideably fitted to the support rod 32. Accordingly, the support plate member 30 is slideable in the first direction. A plurality of auxiliary support portions 35, which are ribs extending in the second direction, are provided integrally with the support plate member 30 between the support rods 32 mutually adjoining in the second direction. That is, the auxiliary support portions 35 and the openings 33 are formed integrally with the support plate member 30. The plurality of auxiliary support portions 35 are arranged in the first direction and provided in parallel to one another. Some of the auxiliary support portions 35 are overlapped with the openings 33. The auxiliary support portions 35 extend in the second direction which is the transport direction of the recording paper P, and thus the recording paper P is guided and transported smoothly. Each of the plurality of auxiliary support portions 35 is formed to have the same height, and the back surface of the recording paper P is supported by the forward end portion on the upper side. Accordingly, the flatness of the recording paper P is secured during the transport. In this arrangement, the auxiliary support portion 35 is provided so that the auxiliary support portion 35 is laid across (to range over) the opening 33. However, the auxiliary support portion 35 may be divided into parts at any intermediate position in the longitudinal direction. As shown in FIG. 5, a gap M is formed between the inner side surface of one frame 31 and one side surface of the support plate member 30 opposed to the inner side surface of the one frame 31. Further, a projection 36, which protrudes toward the other frame 31, is provided on one side surface of the support plate member 30 opposed to the inner side surface of the other frame 31. The support plate member 30 is positioned in the first direction by allowing the projection 36 to be brought in contact with the other frame 31 described above, and the support plate member 30 is movable by the amount of the gap M in the first direction.

Figure 6:
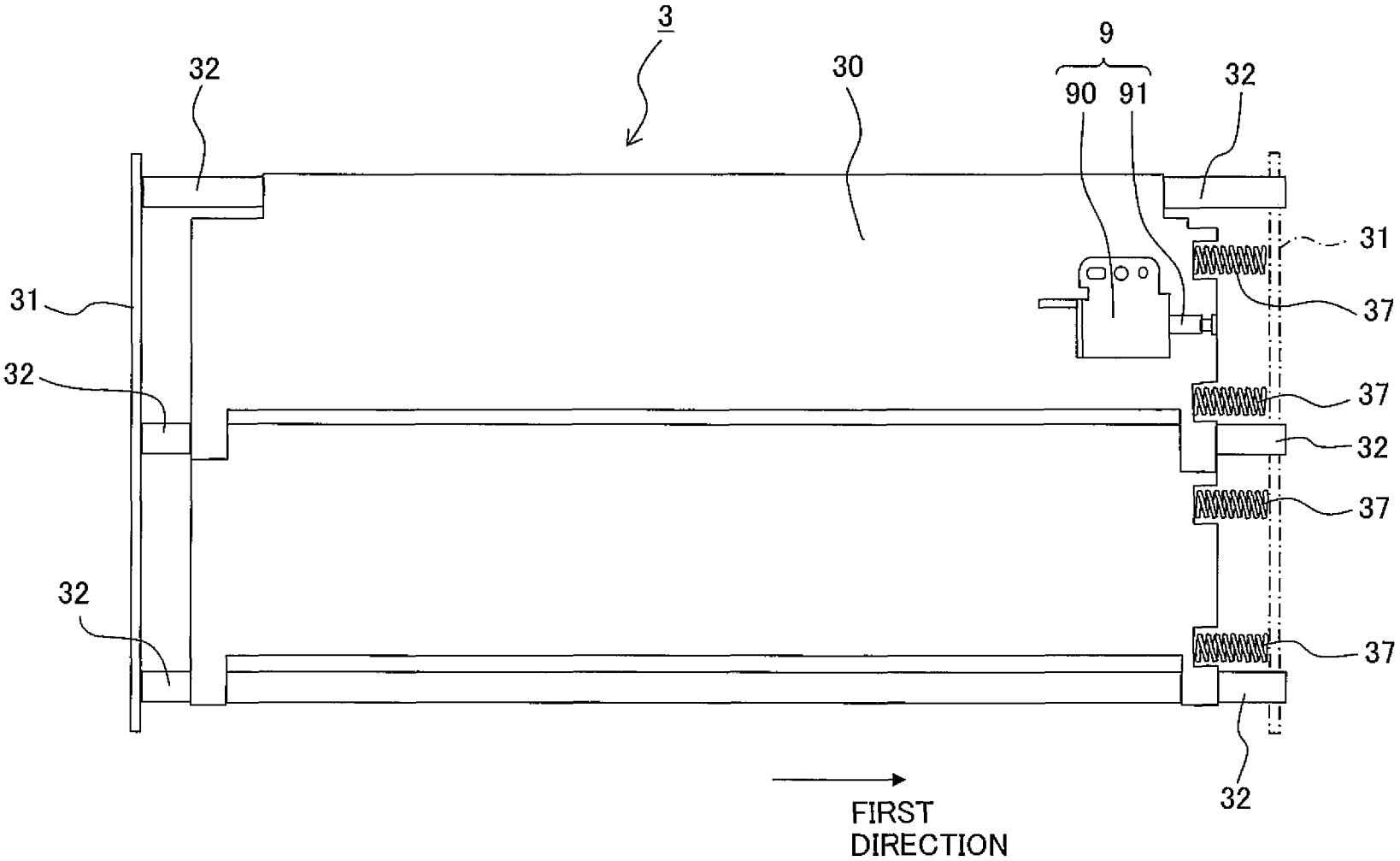
FIG. 6 shows a back view illustrating the platen.

As shown in FIG. 6, compression springs 37 are provided between the one frame 31 and the side portions of the back surfaces of the support plate members 30. The support plate members 30 are urged toward the other frame 31. The opening 33 is not shown in FIG. 6 for the purpose of convenience. A receiving member (not shown) is provided on the lower side of the platen 3, and a solenoid 9 is provided on the receiving member. As known in the art, the solenoid 9 has a spindle 91 which is provided protrudably and retractably with respect to a main body 90. The forward end portion of the spindle 91 is connected to the side portion of the support plate member 30. When the electricity is applied to the main body 90, and the spindle 91 protrudes from the main body 90, then the support plate member 30 is moved in the first direction against the urging force of the compression springs 37. When the main body 90 is released from the application of the electricity, the support plate member 30 is returned to the original position by means of the urging force of the compression springs 37. That is, the support plate member 30 is reciprocatively moved in the first direction in accordance with the protrudable and retractable movement of the spindle 91. The flushing operation is performed by discharging the ink from the discharge surface 40 through the opening 33 toward the liquid receiving member 70. In this procedure, in order that the ink does not adhere to the auxiliary support portion 35, the control unit 8 selects the discharge port 42 for discharging the ink depending on the position of the auxiliary support portion 35.

Figures 7A, 7B, 7C, 7D:
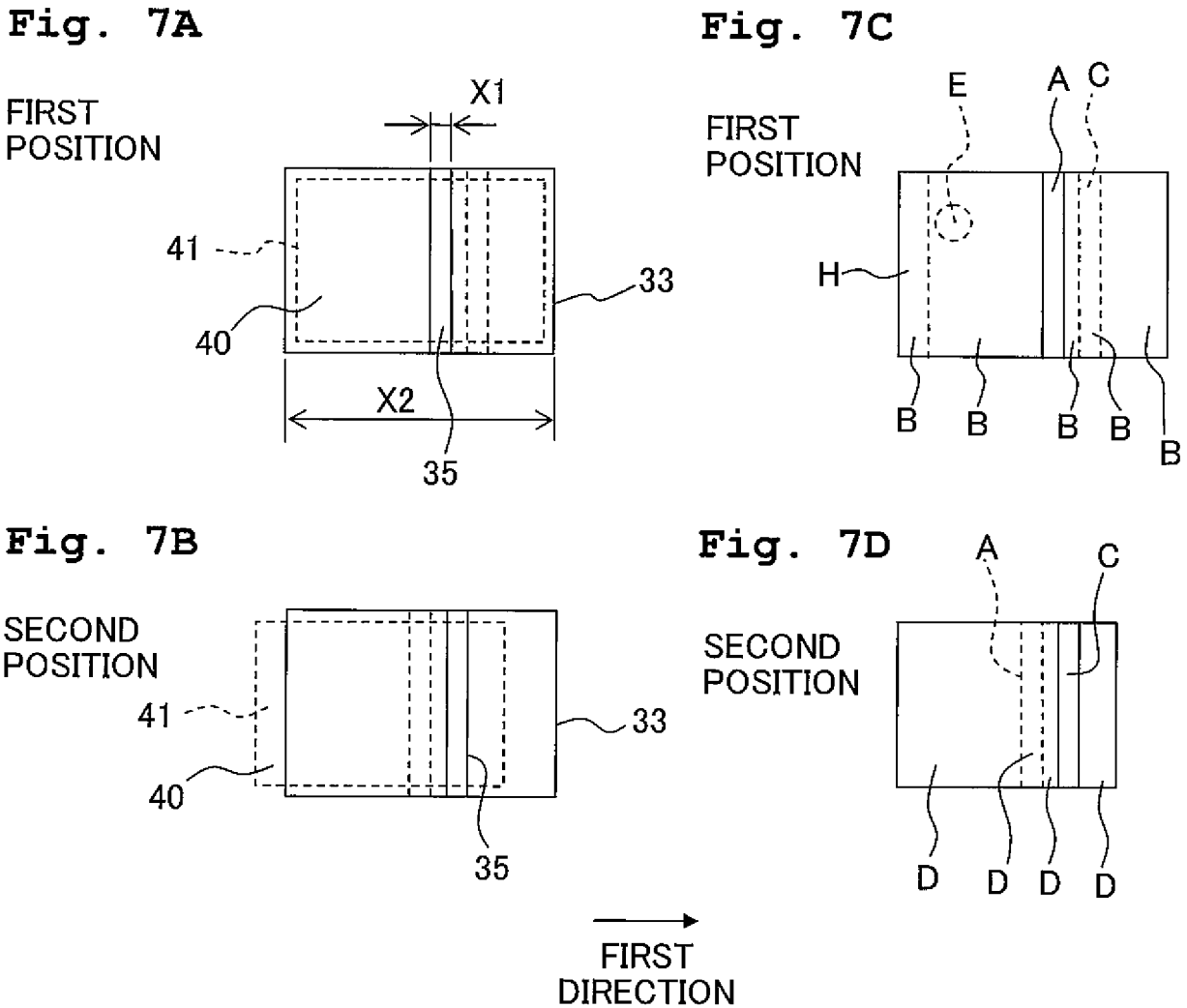
FIGS. 7A to 7D show enlarged views illustrating the positional relationship among one head element, one auxiliary support portion and one opening shown in FIG. 5.

At first, the positional relationship among one head element 41 and one opening 33 and the auxiliary support portion 35 which correspond to the one head element 41 is defined with reference to FIGS. 7A and 7B. In FIGS. 7A and 7B, one auxiliary support portion 35 and one opening 33 shown in FIG. 5 are shown, and one corresponding head element 41 is shown by broken lines while being overlapped therewith. In accordance with the operation of the protrudable and retractable movement of the spindle 91, the support plate member 30 and the auxiliary support portion 35 are moved between the first position which is shown in FIG. 7A and the second position which is separated from the first position in the first direction as shown in FIG. 7B. The solenoid 9 corresponds to the "movement mechanism" of the present invention for moving the auxiliary support portion 35 between the first position and the second position. As shown in FIG. 7C, in the state in which the support plate member 30 and the auxiliary support portion 35 are positioned at the first position, the area of the discharge surface 40 of the liquid discharge head 4, which is opposed to the auxiliary support portion 35, is defined as "first area A", and the area of the discharge surface 40, which is opposed to the opening 33 and which is different from the first area A, is defined as "second area B". Further, as shown in FIG. 7D, in the state in which the support plate member 30 and the auxiliary support portion 35 are positioned at the second position, the area of the discharge surface 40 of the liquid discharge head 4, which is opposed to the auxiliary support portion 35, is defined as "third area C", and the area of the discharge surface 40, which is opposed to the opening 33 and which is different from the third area C, is defined as "fourth area D". In this situation, the third area C is included in the second area B as shown in FIG. 7C, and the first area A is included in the fourth area D as shown in FIG. 7D. The control unit 8 controls the solenoid 9 so that the first area A is included in the fourth area D in the state in which the support plate member 30 and the auxiliary support portion 35 are positioned at the second position, and the third area C is included in the second area B in the state in which the support plate member 30 and the auxiliary support portion 35 are positioned at the first position.

The control unit 8 further controls the liquid discharge head 4 so that the flushing operation is performed toward the liquid receiving member 70 from the discharge port(s) 42 included in the third area C of the plurality of discharge ports 42, in the state in which the auxiliary support portion 35 is positioned at the first position shown in FIG. 7A. The third area C is separated from the first area A in the first direction. Therefore, for example, even when the ink is discharged in a spray form from the discharge port 42 included in the third area C, the ink reliably passes through the opening 33, and the ink does not adhere to the auxiliary support portion 35. In the state in which the auxiliary support portion 35 is positioned at the second position shown in FIG. 7B, the flushing operation is performed toward the liquid receiving member 70 from the discharge port(s) 42 included in the first area A of the plurality of discharge ports 42. The first area A is separated in the first direction from the third area C. Therefore, the ink, which is discharged from the discharge ports 42 included in the first area A, reliably passes through the opening 33, and the ink does not adhere to the auxiliary support portion 35. As for the discharge port 42, which is included in the area such as, for example, an area E shown in FIG. 7C included in the second area B and included in the fourth area C as well, the flushing operation may be performed in any one of the state in which the auxiliary support portion 35 is positioned at the first position and the state in which the auxiliary support portion 35 is positioned at the second position. On the other hand, when the discharge port 42 is included in an area H shown in FIG. 7C, the discharge port 42 is not included in the fourth area D in the state in which the auxiliary support portion 35 is positioned at the second position (i.e., the discharge port 42 is not opposed to the opening 33). Therefore, as for the discharge port 42, it is necessary to perform the flushing operation at the first position.

In FIGS. 7A and 7B, only one auxiliary support portion 35 is shown, which is laid across the opening 33. However, the plurality of auxiliary support portions 35 are provided in the first direction while being laid across one opening 33. Accordingly, it is possible to secure the flatness of the recording paper P having the back surface supported by the auxiliary support portions 35. Further, in FIGS. 7A and 7B, the width X1 in the first direction of the auxiliary support portion 35 is shown to be considerably slenderer or thinner than the width X2 in the first direction of the opening 33. However, when the width in the first direction of the auxiliary support portion 35 is thickened, it is possible to further secure the flatness of the recording paper P having the back surface supported by the auxiliary support portion 35.

When only one auxiliary support portion 35 is provided without providing the plurality of auxiliary support portions 35 in the first direction while being laid across one opening 33, it is necessary that the width X1 of the auxiliary support portion 35 should resides in a length that is less than a half of the width X2 of the opening 33. If the width X1 of the auxiliary support portion 35 is not less than the half of the width X2 of the opening 33, the amount of movement is increased when the auxiliary support portion 35 is moved between the first position and the second position. As a result, the time is spent until the discharge port 42 included in the first area A is included in the fourth area D in accordance with the movement of the auxiliary support portion 35 in the first direction. It especially becomes difficult to perform the flushing operation of the ink during the period corresponding to the spacing distance L between the mutually adjoining recording paper P. In view of the above, in this embodiment, the width X1 of the auxiliary support portion 35 is the length which is less than the half of the width X2 of the opening 33, and thus the amount of movement of the auxiliary support portion 35 in the first direction is decreased. When the plurality of auxiliary support portions 35 are provided in the first direction while being laid across the opening 33, it is necessary that the total value of the widths X1 of the plurality of auxiliary support portions 35 should reside in a length that is less than the half of the width X2 of the opening 33. If the total value of the widths X1 of the plurality of auxiliary support portions 35 is larger than the half of X2, then the discharge port 42 included in the first area A is not included in the fourth area D, and the discharge port 42 included in the third area C is not included in the second area B. Therefore, it is impossible to perform the flushing operation without dirtying the auxiliary support portion 35 with the ink.

Figure 8A:
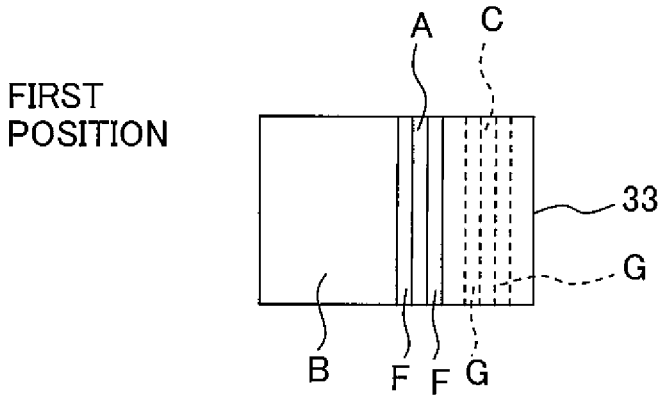
FIGS. 8A and 8B further illustrate the one auxiliary support portion and the one opening shown in FIGS. 7A to 7D.
Figure 8B:
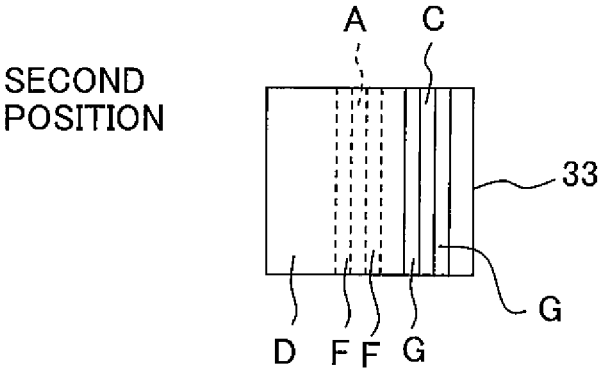
Figure 9:
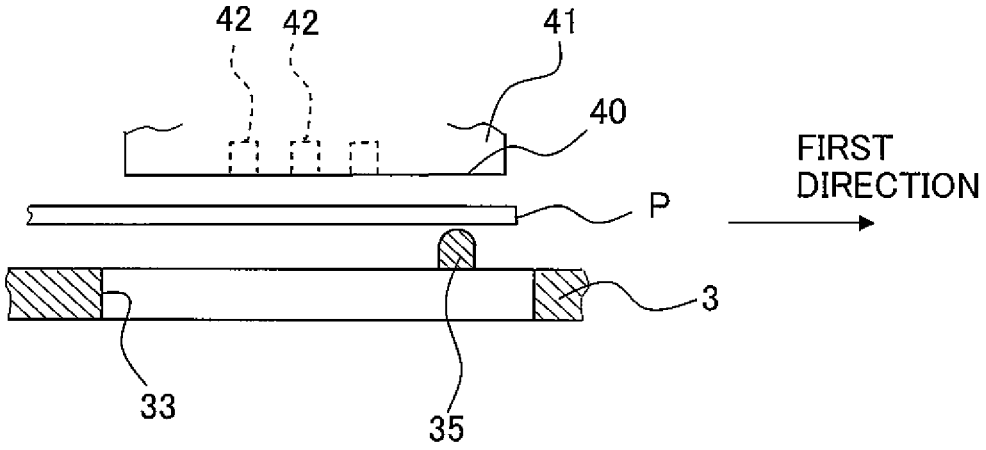
FIG. 9 shows a front view illustrating the positional relationship among the head element, the opening, and the auxiliary support portion.
Figure 10:
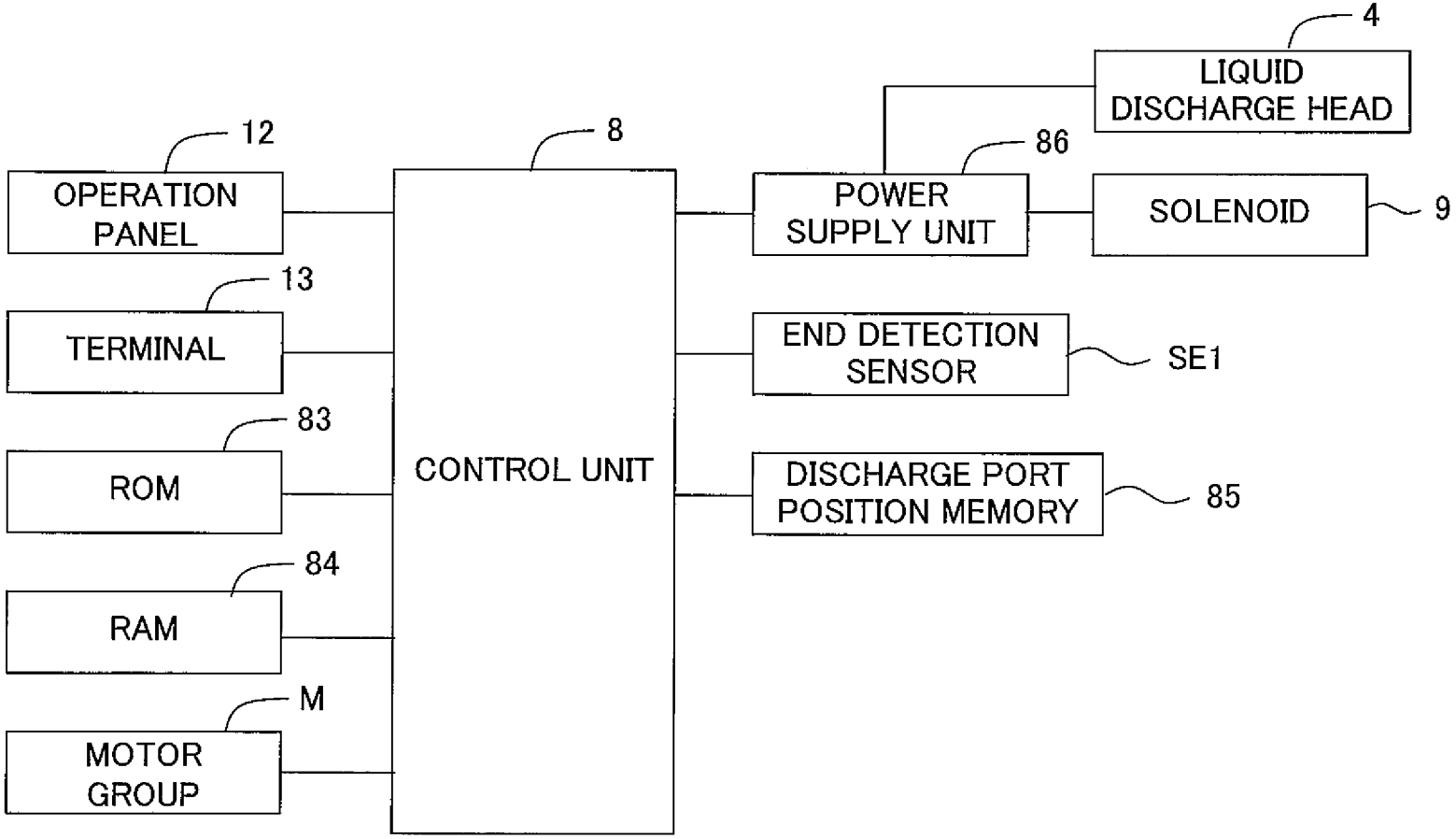
FIG. 10 shows a block diagram illustrating the peripheral structure of a control unit.

As shown in FIG. 8A, the area of the discharge surface 40, which is adjacent to the first area A in the first direction, is defined as "fifth area F". As shown in FIG. 8B, the area of the discharge surface 40, which is adjacent to the third area C in the first direction, is defined as "sixth area G". In other words, the fifth area F indicates the area of the discharge surface 40 which is included in the second area B and which is positioned in the vicinity of the boundary between the first area A and the second area B. Similarly, the sixth area G indicates the area of the discharge surface 40 which is included in the fourth area D and which is positioned in the vicinity of the boundary between the third area C and the fourth area D. In this situation, the control unit 8 may control the solenoid 9 so that the fifth area F is included in the fourth area D in the state in which the support plate member 30 and the auxiliary support portion 35 are positioned at the second position, and the sixth area G is included in the second area B in the state in which the support plate member 30 and the auxiliary support portion 35 are positioned at the first position. That is, the discharge port 42 included in the fifth area F is opposed to the opening 33 in the state in which the auxiliary support portion 35 is positioned at the second position, and the discharge port 42 included in the sixth area G is opposed to the opening 33 in the state in which the auxiliary support portion 35 is positioned at the first position.

The control unit 8 further controls the liquid discharge head 4 so that the flushing operation is performed toward the liquid receiving member 70 with respect to the discharge port(s) included in the third area C of the plurality of discharge ports 42, in the state in which the auxiliary support portion 35 is positioned at the first position shown in FIG. 8A. Even the discharge port 42, which is included in the sixth area G adjacent to the third area C, is opposed to the opening 33. Therefore, the ink, which is subjected to the flushing operation from the discharge port 42 included in the third area C, is hardly adhered to the auxiliary support portion 35. In the state in which the auxiliary support portion 35 is positioned at the second position shown in FIG. 8B, the control unit 8 controls the liquid discharge head 4 so that the flushing operation is performed toward the liquid receiving member 70 from the discharge port 42 included in the first area A. Even the discharge port 42, which is included in the fifth area F adjacent to the first area A, is opposed to the opening 33. Therefore, the ink, which is subjected to the flushing operation from the discharge port 42 included in the first area A, is hardly adhered to the auxiliary support portion 35. Accordingly, for example, even when the ink is discharged from the discharge port 42 in a spray form, then the ink passes through the opening 33, and the auxiliary support portion 35 is not dirtied by the ink.

Further, the control unit 8 does not operate the solenoid 9 when the auxiliary support portion 35 supports the back surface of the recording paper P. That is, the auxiliary support portion 35 is not moved in the first direction for the following reason. That is, if the auxiliary support portion 35 is moved in the first direction when the auxiliary support portion 35 supports the recording paper P, it is feared that the auxiliary support portion 35 may catch the recording paper P. The control unit 8 judges whether or not the auxiliary support portion 35 supports the back surface of the recording paper P, depending on whether or not a predetermined period of time elapses after the end detection sensor SE1 detects the end portion of the recording paper P.

The auxiliary support portion 35 supports the end portion of the recording paper P in the first direction in a state in which the auxiliary support portion 35 is overlapped or covered with the recording paper P. If the recording paper P is transported while allowing the end portion of the recording paper P to hang in the opening 33, it is feared that the recording paper P may be damaged. Therefore, the end portion of the recording paper P is reliably supported by the auxiliary support portion 35 to thereby prevent the recording paper P from being damaged during the transport. In other words, the auxiliary support portion 35 is provided at the position corresponding to the end portion of any regular size paper (for example, A4, postcard), and thus the end portion of the recording paper P is reliably supported to prevent the recording paper P from being damaged during the transport.

Figure 11:
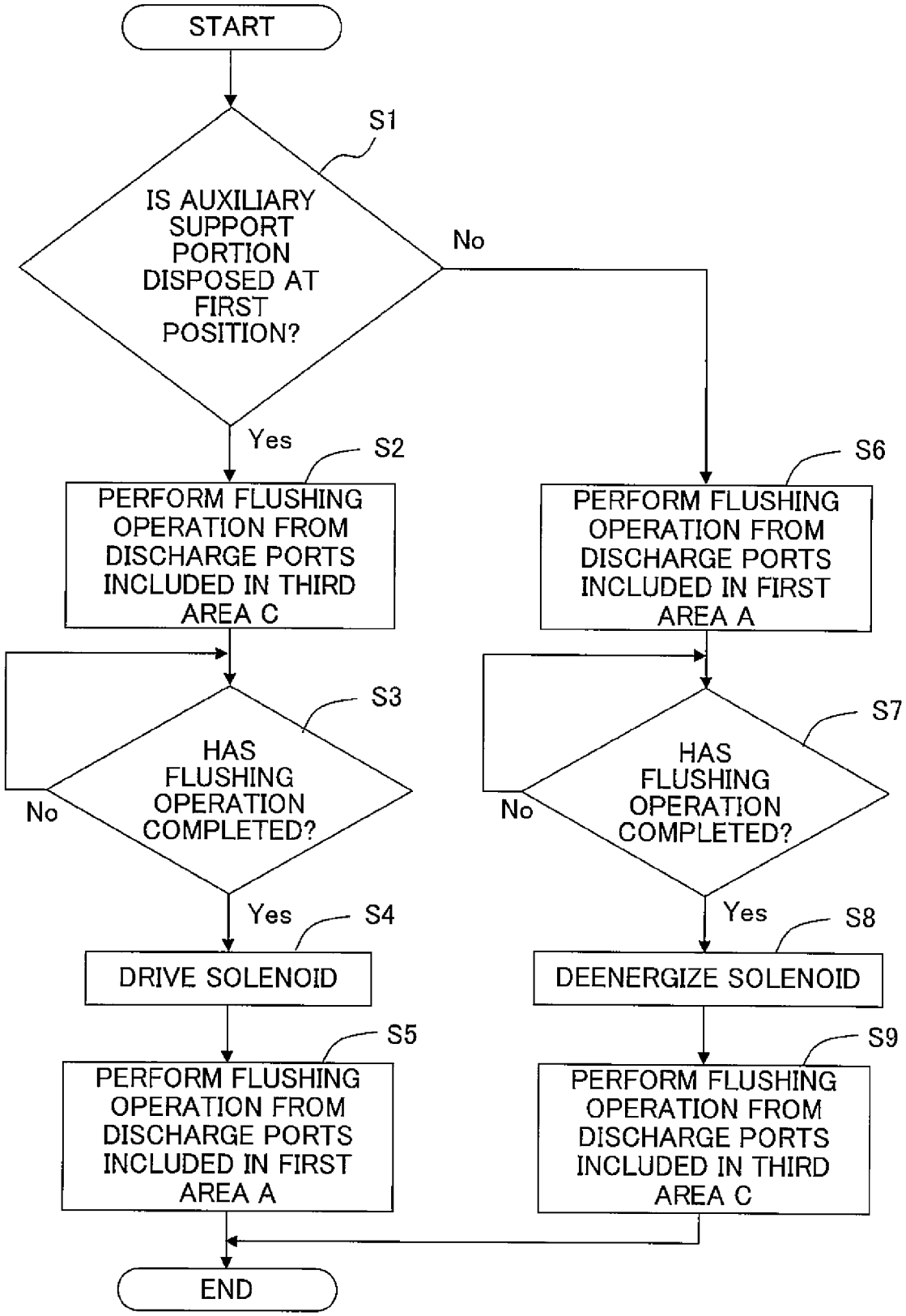
FIG. 11 shows a flow chart illustrating the control operation of the control unit.

The control unit 8 is composed of one CPU. However, the control unit 8 may be a combination of a plurality of CPU's. As for the control unit 8, it is also allowable to use CPU and ASIC (Application Specific Integrated Circuit) in combination. The control unit 8 also functions as a timer while performing the division for the internal clock of CPU. Those connected to the control unit 8 are the operation panel 12 described above, a terminal 13, a motor group M for rotating the first to seventh transport roller pairs 51 to 63, as well as ROM 83 in which an operation program (instruction) is stored, RAM 84 which functions as a work memory for temporarily recording the information, the solenoid 9 and the liquid discharge head 4 connected via a power supply unit 86, the end detection sensor SE1, and a discharge port position memory 85 in which at least the positions in the first direction of the plurality of discharge ports 42 are stored. Image data storage means, which once or temporarily stores the inputted image data, is also connected to the control unit 8. However, the image data storage means is omitted from the description of this specification. When the end portion of the recording paper P, which is disposed on the downstream side in the transport direction, passes across the end detection sensor SE1, the recording paper P passes over the auxiliary support portions 35 on the platen 3 after the elapse of a predetermined time. The control unit 8 operates the timer function to detect the fact that the predetermined time has elapsed, i.e., the fact that the recording paper P has passed over the auxiliary support portion 35 and the recording paper P is not positioned on the auxiliary support portion 35, and then the control unit 8 performs the control shown in a flow chart of FIG. 11. The control as described above is executed based on the program (instruction) stored in ROM 83.

At first, the control unit 8 judges whether the auxiliary support portion 35 is disposed at the first position or the second position according to the electric power application state with respect to the solenoid 9 (Step S1). If the auxiliary support portion 35 is disposed at the first position (Step S1: Yes), the control unit 8 specifies the plurality of discharge ports 42 included in the third area C of the discharge surface 40 in accordance with the discharge port position memory 85 described above to perform the flushing operation of the ink from the specified plurality of discharge ports 42 (Step S2). If the flushing operation of the ink is completed for all of the discharge ports 42 included in the third area C (Step S3: Yes), the control unit 8 drives the solenoid 9 (Step S4) to set the auxiliary support portion 35 at the second position. The control unit 8 performs the flushing operation of the ink from the plurality of discharge ports 42 included in the first area A of the discharge surface 40 (Step S5).

On the other hand, in Step S1, if the auxiliary support portion 35 is disposed at the second position (Step S1: No), the control unit 8 specifies the plurality of discharge ports 42 included in the first area A of the discharge surface 40 in accordance with the discharge port position memory 85 to perform the flushing operation of the ink from the specified plurality of discharge ports 42 (Step S6). If the flushing operation of the ink is completed for all of the discharge ports 42 included in the first area A (Step S7: Yes), the control unit 8 deenergizes the electric power application to the solenoid 9 (Step S8). In this situation, the support plate members 30 and the auxiliary support portions 35 are returned to the original first position by means of the compression springs 37. The control unit 8 performs the flushing operation of the ink from the plurality of discharge ports 42 included in the third area C of the discharge surface 40 (Step S9). Accordingly, it is possible to execute the flushing operation from all of the discharge ports 42 within the time corresponding to the spacing distance between the mutually adjoining recording paper sheets P.

In the ink jet recording apparatus 1 according to the embodiment of the present invention, the auxiliary support portion 35 is moved in the first direction between the first position and the second position. Accordingly, the discharge port 42, which is included in the first area, does not discharge the ink at the first position, and the discharge port 42 discharges the ink at the second position. The discharge port 42, which is included in the third area, does not discharge the ink at the second position, and the discharge port 42 discharges the ink at the first position. That is, the liquid can be discharged uniformly from all of the discharge ports 42 by moving the auxiliary support portion 35 in the first direction between the first position and the second position. Accordingly, the auxiliary support portion 35 can be formed at the position opposed to the discharge port 42 to secure the flatness of the recording paper P during the transport. Further, even when the plurality of discharge ports 42 are formed, the discharge ports 42 can be prevented from being opposed to the auxiliary support portion 35, and the auxiliary support portion 35 can be prevented from being dirtied by the ink.

In the embodiment described above, the auxiliary support portions 35 are formed integrally with the support plate member 30, and the auxiliary support portions 35 are moved in the first direction together with the support plate member 30. However, in place of such an arrangement, the support plate member 30 may be fixed to the frame 31, and only the auxiliary support portions 35 may be moved in the first direction. Also in this case, the auxiliary support portion 35 and the head element 41 fulfill the positional relationship shown in FIGS. 7A and 7B.

In the embodiment described above, the auxiliary support portions 35 are constructed to be moved in the first direction by the solenoid 9. However, it is also allowable that the auxiliary support portions 35 are constructed to be moved in the first direction by a motor (not shown) in place of the solenoid 9.

What is claimed is:

1. A liquid discharge apparatus comprising:

a liquid discharge head in which a plurality of discharge ports for discharging a liquid are arranged in a first direction;

a transport mechanism which is configured to transport a recording medium in a second direction perpendicular to the first direction;

a platen which is provided opposingly to the plurality of discharge ports of the liquid discharge head and configured to support the recording medium to be transported by the transport mechanism, the platen having an opening which is formed so that the liquid, which is discharged from the plurality of discharge ports, passes therethrough, and an auxiliary support portion which is provided to be laid across a part of the opening so that the recording medium, which is to be transported across a position overlapped with the opening, is supported;

a liquid receiving member which is provided on a side opposite to the liquid discharge head with respect to the platen and configured to receive the liquid discharged from the plurality of discharge ports of the liquid discharge head;

a movement mechanism which is configured to move at least the auxiliary support portion of the platen between a first position and a second position separated in the first direction from the first position; and a control unit which is configured to control at least the liquid discharge head and the movement mechanism, wherein the liquid discharge head includes:

a first area which is opposed to the auxiliary support portion and a second area which is opposed to the opening and which is different from the first area, in a state in which the auxiliary support portion is positioned at the first position; and a third area which is opposed to the auxiliary support portion and a fourth area which is opposed to the opening and which is different from the third area, in a state in which the auxiliary support portion is positioned at the second position, and wherein the control unit is configured to:

control the movement mechanism so that the first area is included in the fourth area in the state in which the auxiliary support portion is positioned at the second position and the third area is included in the second area in the state in which the auxiliary support portion is positioned at the first position;

control the liquid discharge head in the state in which the auxiliary support portion is positioned at the first position so that the liquid is discharged toward the liquid receiving member from the discharge ports of the plurality of discharge ports included in the third area; and control the liquid discharge head in the state in which the auxiliary support portion is positioned at the second position so that the liquid is discharged toward the liquid receiving member from the discharge ports of the plurality of discharge ports included in the first area.

2. The liquid discharge apparatus according to claim 1, wherein the control unit is configured to further control the transport mechanism so that a plurality of sheets of the recording medium are transported while providing a predetermined spacing distance, and the control unit is configured to control the liquid discharge head so that the liquid is discharged from the plurality of discharge ports toward the liquid receiving member within a period which corresponds to the predetermined spacing distance and in which the recording medium transported by the transport mechanism is not opposed to the plurality of discharge ports.

3. The liquid discharge apparatus according to claim 1, wherein the discharge head further includes:

a fifth area which is positioned, in the second area, in the vicinity of a boundary between the first area and the second area, in the state in which the auxiliary support portion is positioned at the first position; and a sixth area which is positioned, in the fourth area, in the vicinity of a boundary between the third area and the fourth area, in the state in which the auxiliary support portion is positioned at the second position; and the control unit is configured to control the movement mechanism so that the fifth area is included in the fourth area in the state in which the auxiliary support portion is positioned at the second position, and the sixth area is included in the second area in the state in which the auxiliary support portion is positioned at the first position.

4. The liquid discharge apparatus according to claim 1, wherein the auxiliary support portion extends in the second direction.

5. The liquid discharge apparatus according to claim 1, wherein the control unit is configured to control the movement mechanism so that the auxiliary support portion is not moved in the first direction in a state in which the auxiliary support portion supports the recording medium.

6. The liquid discharge apparatus according to claim 1, wherein the auxiliary support portion is configured so that a width in the first direction is less than a half of a width of the opening in the first direction.

7. The liquid discharge apparatus according to claim 1, wherein the platen further includes a support plate member which is formed with the opening, and the auxiliary support portion is formed integrally with the support plate member.

8. The liquid discharge apparatus according to claim 1, wherein the platen further includes a support plate member which is formed with the opening and which is fixed with respect to the first direction, and the auxiliary support portion is configured to be movable in the first direction with respect to the support plate member.

9. The liquid discharge apparatus according to claim 1, wherein the auxiliary support portion is configured to support an end portion in the first direction of the recording medium in a state in which the recording medium is overlapped therewith.

10. The liquid discharge apparatus according to claim 1, wherein the opening is formed as a plurality of openings arranged in a zigzag form in the first direction, the liquid discharge head has a plurality of head elements which are opposed to the plurality of openings respectively, the plurality of head elements being arranged in a zigzag form in the first direction, and the plurality of discharge ports are formed on surfaces of the respective head elements opposing to the recording medium.

11. A liquid discharge method for a liquid discharge apparatus, the liquid discharge apparatus including a liquid discharge head in which a plurality of discharge ports for discharging a liquid are arranged in a first direction; a transport mechanism which is configured to transport a recording medium in a second direction perpendicular to the first direction; a platen which is provided opposingly to the plurality of discharge ports of the liquid discharge head and configured to support the recording medium to be transported by the transport mechanism, the platen having an opening which is formed so that the liquid, which is discharged from the plurality of discharge ports, passes therethrough, and an auxiliary support portion which is provided to be laid across a part of the opening so that the recording medium, which is to be transported across a position overlapped with the opening, is supported; a liquid receiving member which is provided on a side opposite to the liquid discharge head with respect to the platen and configured to receive the liquid discharged from the plurality of discharge ports of the liquid discharge head; a movement mechanism which is configured to move at least the auxiliary support portion of the platen between a first position and a second position separated in the first direction from the first position; and a control unit which is configured to control at least the liquid discharge head and the movement mechanism; wherein the liquid discharge head includes: a first area which is opposed to the auxiliary support portion and a second area which is opposed to the opening and which is different from the first area, in a state in which the auxiliary support portion is positioned at the first position; and a third area which is opposed to the auxiliary support portion and a fourth area which is opposed to the opening and which is different from the third area, in a state in which the auxiliary support portion is positioned at the second position; and the liquid discharge method comprising:

controlling the movement mechanism so that the first area is included in the fourth area in the state in which the auxiliary support portion is positioned at the second position and the third area is included in the second area in the state in which the auxiliary support portion is positioned at the first position;

controlling the liquid discharge head in the state in which the auxiliary support portion is positioned at the first position so that the liquid is discharged toward the liquid receiving member from the discharge ports of the plurality of discharge ports included in the third area; and controlling the liquid discharge head in the state in which the auxiliary support portion is positioned at the second position so that the liquid is discharged toward the liquid receiving member from the discharge ports of the plurality of discharge ports included in the first area.

12. A storage medium storing computer-executable instructions for a liquid discharge apparatus, the liquid discharge apparatus comprising: a liquid discharge head in which a plurality of discharge ports for discharging a liquid are arranged in a first direction; a transport mechanism which is configured to transport a recording medium in a second direction perpendicular to the first direction; a platen which is provided opposingly to the plurality of discharge ports of the liquid discharge head and configured to support the recording medium to be transported by the transport mechanism, the platen having an opening which is formed so that the liquid, which is discharged from the plurality of discharge ports, passes therethrough, and an auxiliary support portion which is provided to be laid across a part of the opening so that the recording medium, which is to be transported across a position overlapped with the opening, is supported; a liquid receiving member which is provided on a side opposite to the liquid discharge head with respect to the platen and configured to receive the liquid discharged from the plurality of discharge ports of the liquid discharge head; a movement mechanism which is configured to move at least the auxiliary support portion of the platen between a first position and a second position separated in the first direction from the first position; and a control unit which is configured to control at least the liquid discharge head and the movement mechanism; wherein the liquid discharge head includes: a first area which is opposed to the auxiliary support portion and a second area which is opposed to the opening and which is different from the first area, in a state in which the auxiliary support portion is positioned at the first position; and a third area which is opposed to the auxiliary support portion and a fourth area which is opposed to the opening and which is different from the third area, in a state in which the auxiliary support portion is positioned at the second position, and the instructions, when executed by a processor, causing the liquid discharge apparatus to:

control the movement mechanism so that the first area is included in the fourth area in the state in which the auxiliary support portion is positioned at the second position and the third area is included in the second area in the state in which the auxiliary support portion is positioned at the first position;

control the liquid discharge head in the state in which the auxiliary support portion is positioned at the first position so that the liquid is discharged toward the liquid receiving member from the discharge ports of the plurality of discharge ports included in the third area; and control the liquid discharge head in the state in which the auxiliary support portion is positioned at the second position so that the liquid is discharged toward the liquid receiving member from the discharge ports of the plurality of discharge ports included in the first area.

* * * * *